US006644882B2

(12) United States Patent
Brown et al.

(10) Patent No.: US 6,644,882 B2
(45) **Date of Patent: *Nov. 11, 2003**

(54) FOLDER

(75) Inventors: Julian Francis Brown, Turleigh (GB); Timothy John Parsey, Chicago, IL (US); Timothy Edward McKeown, St. Joseph, MI (US); Fred Edward Cecala, Mount Prospect, IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/104,555

(22) Filed: Mar. 22, 2002

(65) Prior Publication Data

US 2002/0098031 A1 Jul. 25, 2002

Related U.S. Application Data

(60) Continuation of application No. 09/796,638, filed on Mar. 2, 2001, now Pat. No. 6,364,559, which is a division of application No. 09/157,367, filed on Sep. 21, 1998, now Pat. No. 6,213,668.

(51) Int. Cl.[7] ..... B42F 13/00

(52) U.S. Cl. ..... 402/73; 281/15.1; 281/36; 281/40; 206/509; 402/3; 402/26; 402/70

(58) Field of Search ..... 281/36, 37, 38, 281/16, 15.1, 17, 27, 34, 40; 206/509; 402/3, 70, 73, 26, 75; 412/17; D19/26, 27

(56) References Cited

U.S. PATENT DOCUMENTS

| | | | | |
|---|---|---|---|---|
| 849,973 | A | | 4/1907 | Buchan |
| 871,610 | A | | 11/1907 | Nash |
| 1,020,561 | A | | 3/1912 | Krumming |
| 1,109,345 | A | | 9/1914 | Mawbey |
| 1,369,309 | A | | 2/1921 | Trussell |
| 1,724,407 | A | | 8/1929 | Lotter |
| 1,887,530 | A | | 11/1932 | Trussell |
| 1,923,081 | A | | 8/1933 | Elsner |
| 2,512,415 | A | | 6/1950 | Buenger et al. |
| 2,671,676 | A | * | 3/1954 | Rundblad ..... 281/19.2 |
| 3,074,744 | A | | 1/1963 | Pucci et al. |
| 3,132,649 | A | | 5/1964 | Gits |
| 3,201,145 | A | | 8/1965 | Libby |
| 3,315,325 | A | | 4/1967 | Cornelius |

(List continued on next page.)

FOREIGN PATENT DOCUMENTS

| | | |
|---|---|---|
| CA | 750260 | 1/1967 |
| DE | 377 195 | 6/1923 |
| DE | 1 436 113 | 11/1968 |

(List continued on next page.)

OTHER PUBLICATIONS

U.S. Design patent application Ser. No. 29/093,896, filed Sep. 21, 1998, entitled "Binder," of J. Brown et al.

*Primary Examiner*—A. L. Wellington
*Assistant Examiner*—Monica S. Carter
(74) *Attorney, Agent, or Firm*—Michael Best & Friedrich LLP

(57) ABSTRACT

A folder includes a spine having a base and first and second spine hinge portions. The spine defines a longitudinal axis and has an exterior surface that is curved around the longitudinal axis. The folder also includes a first cover having a first cover hinge portion pivotably attached to the first spine hinge portion. The first cover has a first curved portion with an exterior surface that is curved around the longitudinal axis. The folder further includes a second cover having a second cover hinge portion pivotably attached to the second spine hinge portion. The second cover has a second curved portion with an exterior surface that is curved around the longitudinal axis. The spine and the first and second curved portions together define a generally rounded contour around the longitudinal axis when the folder is in a closed position.

22 Claims, 7 Drawing Sheets

U.S. PATENT DOCUMENTS

| | | | | | |
|---|---|---|---|---|---|
| 3,335,508 | A | | 8/1967 | Hummel | |
| 3,572,957 | A | | 3/1971 | Strassberg | |
| 3,771,890 | A | | 11/1973 | Notto | |
| 3,837,680 | A | | 9/1974 | Cimini | |
| 3,968,546 | A | | 7/1976 | Seaborn et al. | |
| 4,114,240 | A | | 9/1978 | Nackenson | |
| 4,295,747 | A | | 10/1981 | Errichiello | |
| 4,315,642 | A | | 2/1982 | Errichiello | |
| 4,569,613 | A | | 2/1986 | Thomas | |
| 4,583,877 | A | | 4/1986 | Wilson | |
| 4,588,321 | A | | 5/1986 | Egly | |
| 4,630,843 | A | | 12/1986 | Willat | |
| 4,856,817 | A | | 8/1989 | Moor | |
| D313,619 | S | * | 1/1991 | Moor | D19/27 |
| D316,872 | S | | 5/1991 | Witschi | |
| 5,015,011 | A | | 5/1991 | York | |
| D319,659 | S | * | 9/1991 | Moor | D19/27 |
| D319,660 | S | * | 9/1991 | Moor | D19/27 |
| 5,108,212 | A | | 4/1992 | Lee | |
| 5,209,593 | A | | 5/1993 | Ros | |
| 5,213,368 | A | | 5/1993 | Wyant | |
| 5,219,437 | A | * | 6/1993 | Moor et al. | 281/29 |
| 5,222,825 | A | | 6/1993 | Wyant | |
| 5,273,319 | A | | 12/1993 | Lee | |
| D347,022 | S | * | 5/1994 | Schattner | D19/27 |
| 5,351,992 | A | | 10/1994 | Chilson et al. | |
| D352,309 | S | | 11/1994 | Gresham et al. | |
| 5,394,913 | A | * | 3/1995 | Zezza et al. | 150/146 |
| D366,496 | S | | 1/1996 | Yiu | |
| 5,553,959 | A | | 9/1996 | Feldman et al. | |
| 5,620,207 | A | | 4/1997 | Podosek et al. | |
| 5,672,022 | A | | 9/1997 | Lin | |
| 5,695,295 | A | | 12/1997 | Ayele et al. | |
| D413,923 | S | * | 9/1999 | Brown et al. | D19/26 |
| D414,801 | S | * | 10/1999 | Karten et al. | D19/27 |
| 6,213,668 | B1 | * | 4/2001 | Brown et al. | 281/27.1 |
| 6,364,559 | B2 | * | 4/2002 | Brown et al. | 206/509 |

FOREIGN PATENT DOCUMENTS

| | | |
|---|---|---|
| DK | 1436175 | 6/1969 |
| FR | 731 642 | 9/1932 |
| FR | 970 197 | 1/1951 |
| FR | 1 525 272 | 5/1968 |
| FR | 2 666 276 | 3/1992 |
| GB | 523502 | 7/1940 |
| GB | 1313254 | 8/1968 |
| GB | 1 214 477 | 12/1970 |
| GB | 2 030 074 | 4/1980 |
| NL | 44995 | 1/1939 |

* cited by examiner

FOLDER

RELATED APPLICATIONS

This is a Continuation application of U.S. patent application Ser. No. 09/796,638, filed Mar. 2, 2001 now U.S. Pat. No. 6,364,559, which is a Divisional application of U.S. patent application Ser. No. 09/157,367, filed Sep. 21, 1998, now U.S. Pat. No. 6,213,668.

BACKGROUND OF THE INVENTION

Loose leaf binders typically have two covers that pivot with respect to a binding assembly. Most binders have a spine connecting the covers.

U.S. Pat. No. 3,771,890 teaches a loose-leaf binder formed from a single piece of molded plastic. The binder has only a front and a back cover joined at a flexible portion located at the back of the binder. Each of three split-ring members are mounted to both covers to bias them towards open or closed positions. The covers have curved, directly hinged portions that extend around and are biased by the ring members. Because the covers need to reach completely around the rings, in the open position the shape of the covers lifts papers bound in the rings high above the surface on which the binder is rested when compared to a binder with a spine, which can lay flatter against the surface as the covers are not required to be able to extend completely behind the rings.

Most ring binders, however, have a spine pivotably connected between two covers such that either cover can be opened independently. U.S. Pat. No. 4,295,747, for instance, shows an integrally molded loose-leaf book, in which front and rear cover panels are integrally molded with a spine, and are connected thereto by living hinges. The spine has a rounded contour, and the front and rear cover panels are flat. Thus, when the book laid open on a flat surface in an open position, weight on the cover panels is supported by lateral edges of the cover panels, which rest on the flat surface, and by the living hinges, which are raised above the flat surface by the raised lateral edges of the spine. This can lead to accelerated wear on the hinges, which are already formed as weakened notches.

The '747 patent also discloses mounting posts that are formed on an inner face of the spine. The posts extend through holes in a matrix strip of a snap-ring assembly. The matrix is secured to the posts with rivets or with fingers of the matrix that bite into the posts.

A binder is thus needed which has a spine that connects two covers, but in which stress is relieved from the hinges where the covers meet the spine.

SUMMARY OF THE INVENTION

The invention provides a folder including a spine having a base and first and second spine hinge portions. The spine defines a longitudinal axis and has an exterior surface that is curved around the longitudinal axis. The folder also includes a first cover having a first cover hinge portion pivotably attached to the first spine hinge portion. The first cover has a first curved portion with an exterior surface that is curved around the longitudinal axis. The folder further includes a second cover having a second cover hinge portion pivotably attached to the second spine hinge portion. The second cover has a second curved portion with an exterior surface that is curved around the longitudinal axis. The spine and the first and second curved portions together define a generally rounded contour around the longitudinal axis when the folder is in a closed position.

Preferably, the rounded contour defined by the spine and the first and second curved portions extends along a generally circular or elliptical shape around the longitudinal axis over an angle of approximately 185 degrees.

In one aspect of the invention, the folder is part of a binder having a binding mechanism coupled to the spine and configured for binding a stack of paper. The binding mechanism includes at least two rings. The spine includes a projection that is aligned with one of the two rings when the binding mechanism is coupled to the spine. Preferably, the ring in alignment with the projection lies in a plane transverse to the spine, and the projection is intersected by the plane.

DETAILED DESCRIPTION OF THE PREFERRED EMBODIMENTS

Figure 1:
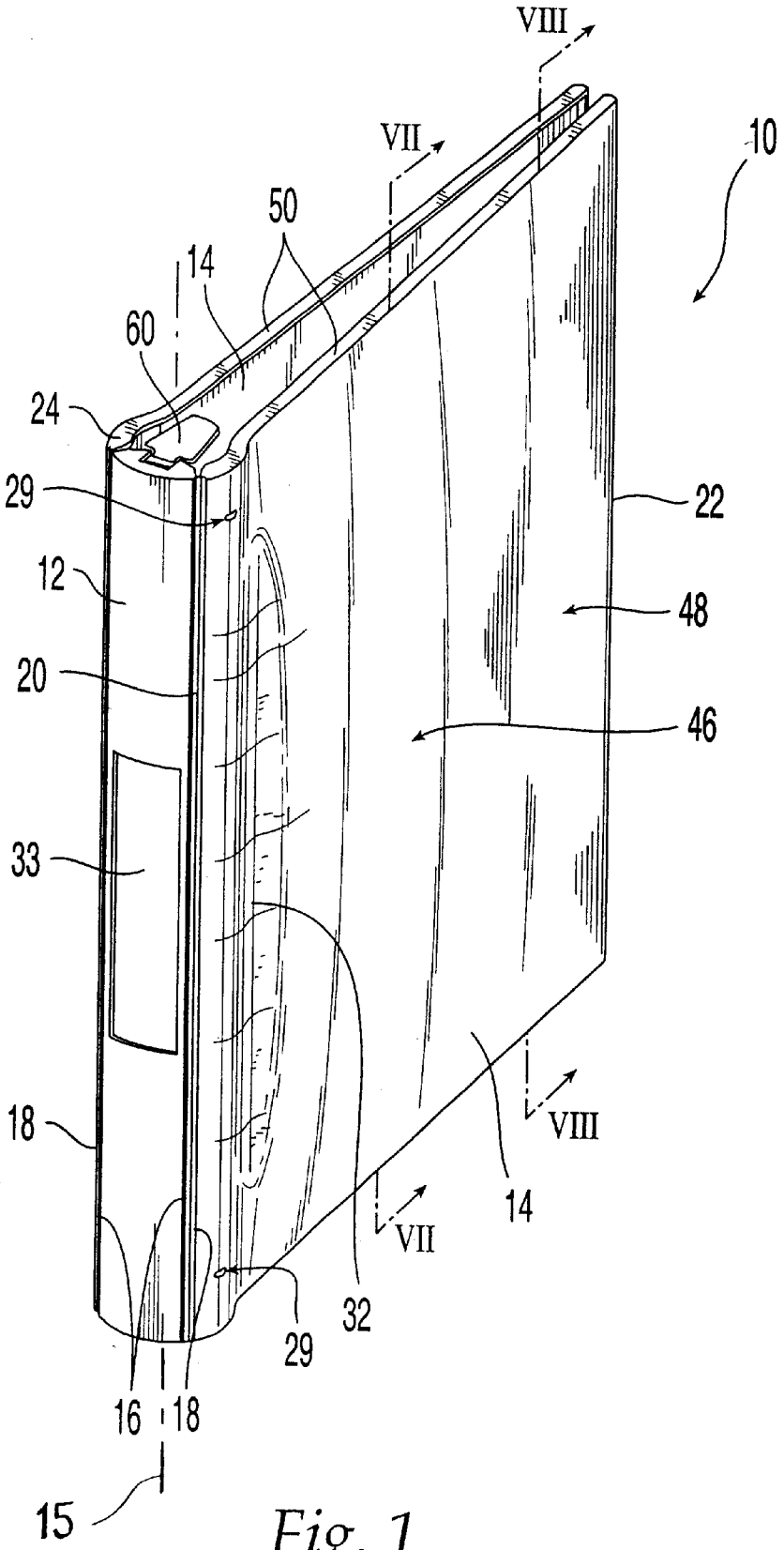
FIG. 1 is a perspective view of a binder constructed according to the present invention.
Figure 2:
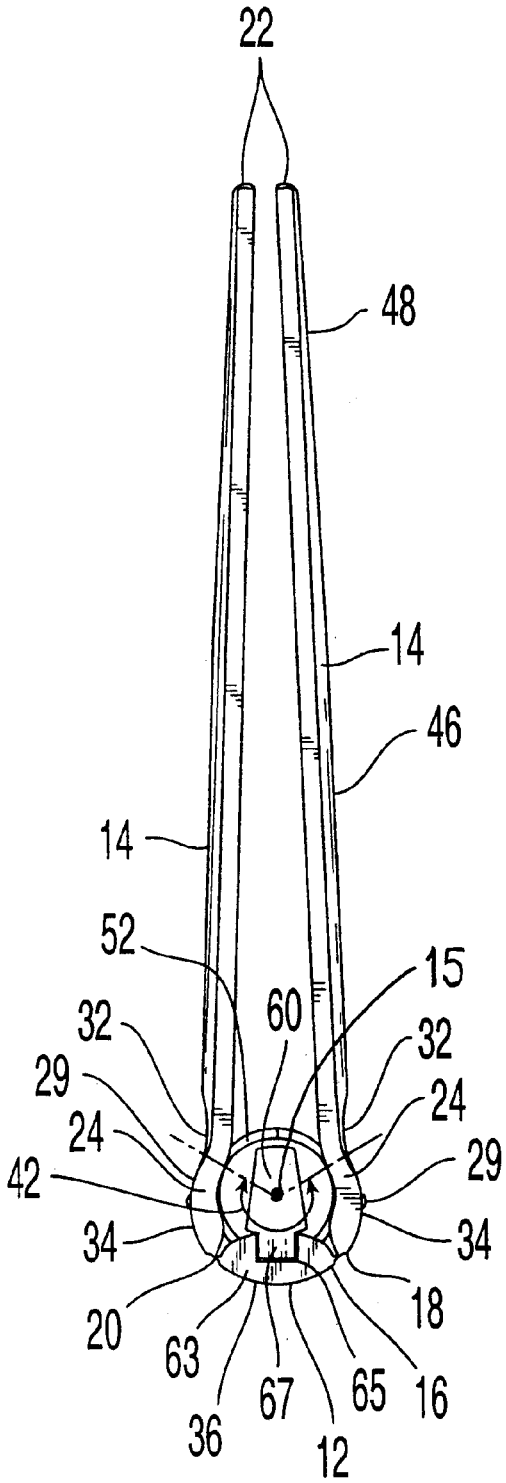
FIG. 2 is a side view of the binder.

Referring to FIGS. 1–2, folder shell 10 preferably has three panels, including a spine 12 and front and back covers 14. Together, the spine 12 and the covers 14 define a longitudinal axis 15. The spine 12 is pivotably connected at spine hinge portions 16 to cover hinge portions 18 of the covers 14. The hinge portions 16, 18 are joined preferably by thinned regions of the folder shell 10 that are living hinges 20. The folder shell 10, including the covers 14 and the spine 12 are a molded plastic of a unitary construction, which is at least semirigid. Preferably, only a single layer of plastic is employed, but multiple layers can also be used.

Figure 3:
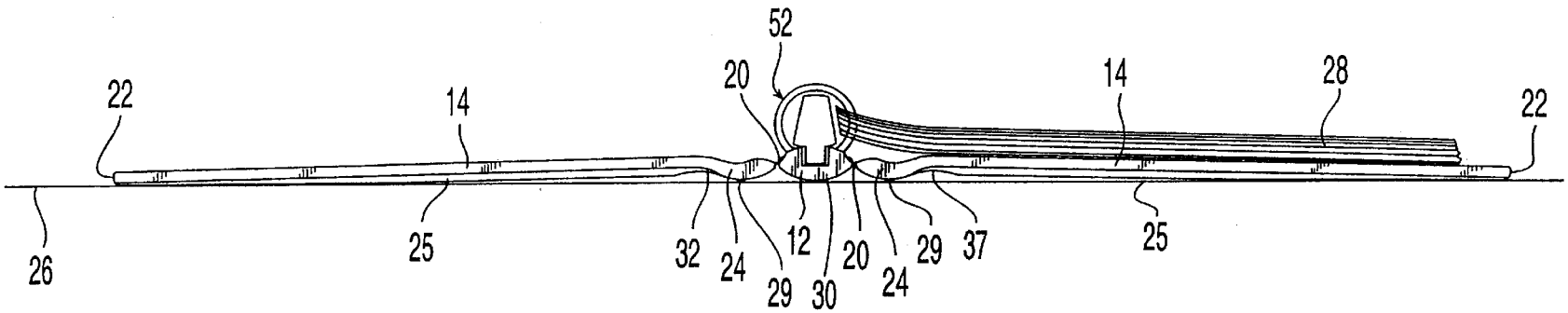
FIG. 3 is a side view thereof in an open position.

The covers 14 have free ends 22 disposed opposite from the hinge portions 18 of the covers 14. Between the free ends 22 and the cover hinge portions 18 are support portions 24. Each support portion 24 is disposed further outwardly than each cover hinge portion 18, and further outwardly than a plane or surface that extends between the hinge portion 18 and either the free end 22 of each cover 14. Thus, as shown in FIG. 3, the support portions 24 are configured such that when the folder shell 10 is in an open position shown with the covers 14 spread apart, the support portions 24 and a resting portion 25 of the covers disposed beyond the support portions 24 with respect to the spine 12, such as the free ends 22, are disposed substantially in a common plane against a planar surface 26 on which the folder is laid. As a result, loads imposed on the covers 14 by papers 28 held in the binder are supported by the support portions 24 and the resting portions 25, instead of by the weakened hinges 20.

Also, the spine 12 has a base 30 disposed between the spine hinge portions 16 and disposed outwardly therefrom and from a plane or surface extending between the spine hinge portions 16. Preferably the spine base 30 is also disposed near or substantially against the surface 26 in the common plane with the support portions 24 and resting portions 25 when the folder shell 10 is open, but can be disposed above the surface 26. The spine 12 also includes a recessed portion 33 configured for receiving and locating a label to identify the binder.

Figure 4:
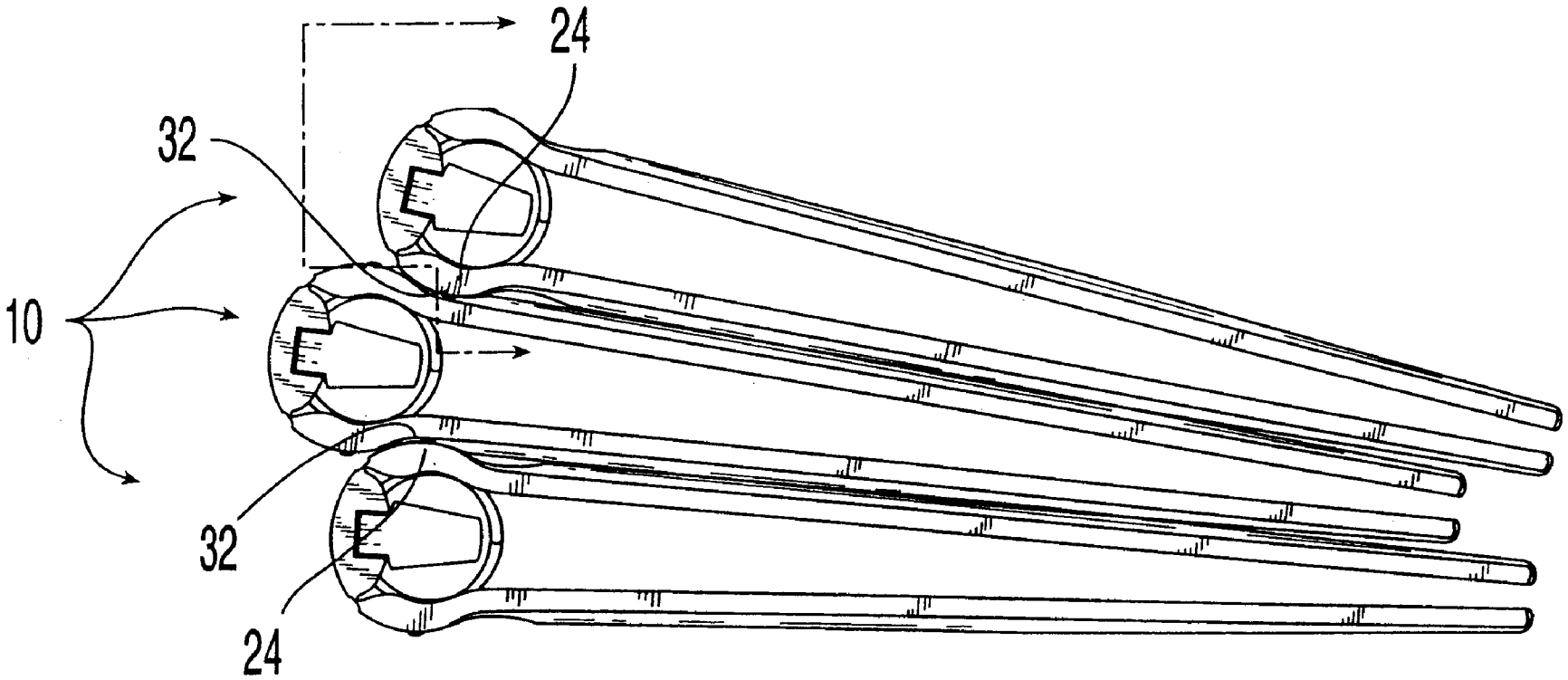
FIG. 4 is a side view of a stack of several binders constructed according the invention.

The support portion 24 are generally convex. Between the support portion 24 and the free ends 22 or resting portions 25 are concave portions 32, which are preferably disposed adjacent the support portion 24, forming an S-curve therewith. Each concave portion 32 is configured to receive the support portions of another similarly constructed folder shell, as shown in FIG. 4. Each concave portion 32 preferably has a semi-cylindrical surface that substantially corresponds with the shape of the semi-cylindrical surface of the support portion 24 of the other cover 14. As a result, two similar folder shells 10 can be stacked facing in a same direction with support portion 24 received in concave portions 32 to restrict or prevent lateral sliding therebetween.

The support portion 24 and spine 12 have exterior surfaces 34, 36 substantially in continuation of each other, which together define a generally rounded contour around the longitudinal axis 15 when the folder shell 10 is in the closed position shown in FIG. 2. The rounded contour makes the binder easier to grasp and hold by a user and allows the folder 10 to be stood upright on the top or bottom sides or longitudinal edges 50. The rounded contour preferably extends along an elliptical or circular shape over an angle 42 of at least about 185 degrees of a generally elliptical shape. The preferred outer radius of the spine 12 is preferably slightly larger than that of the support portions 24.

Figure 5:
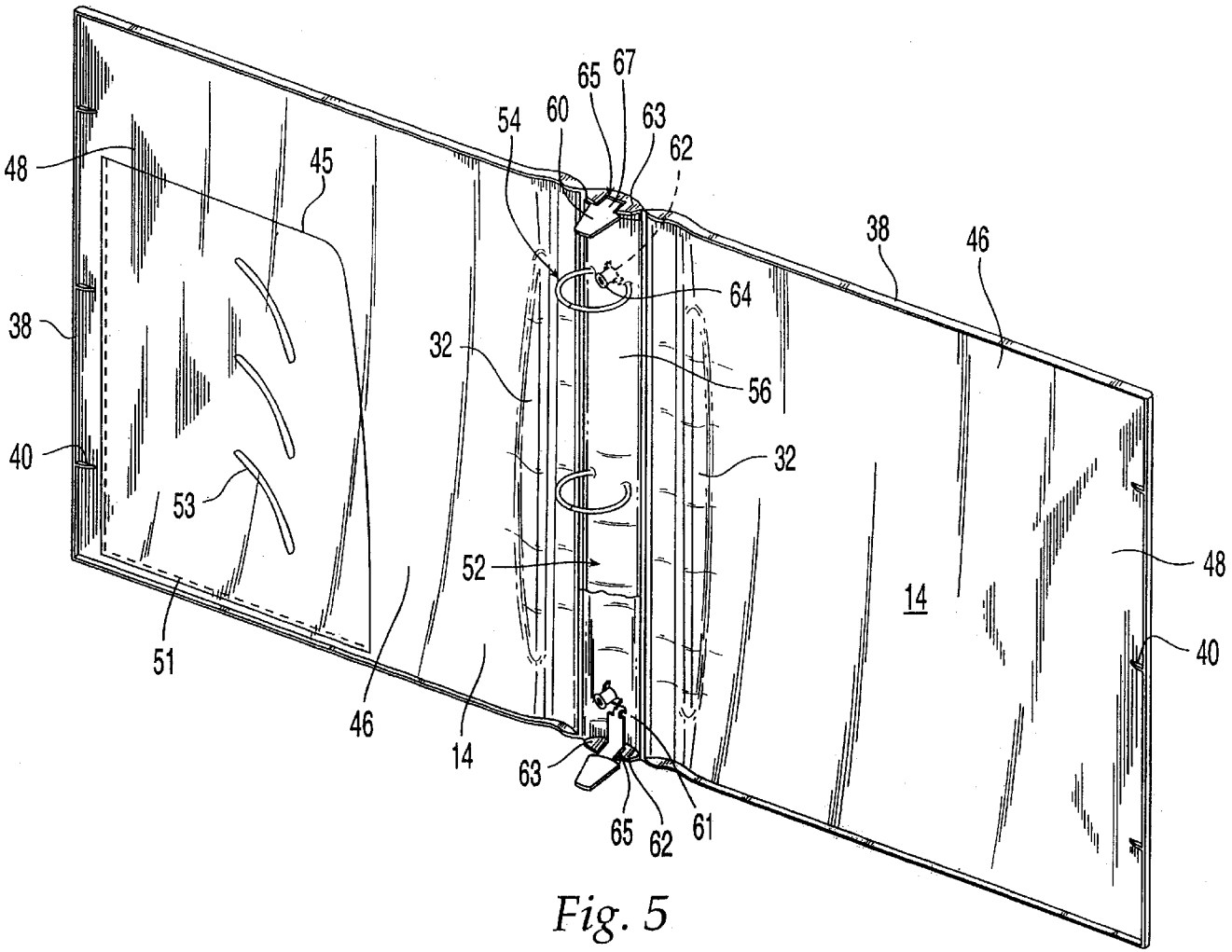
FIG. 5 is a perspective view of the binder in the open position.
Figure 6:
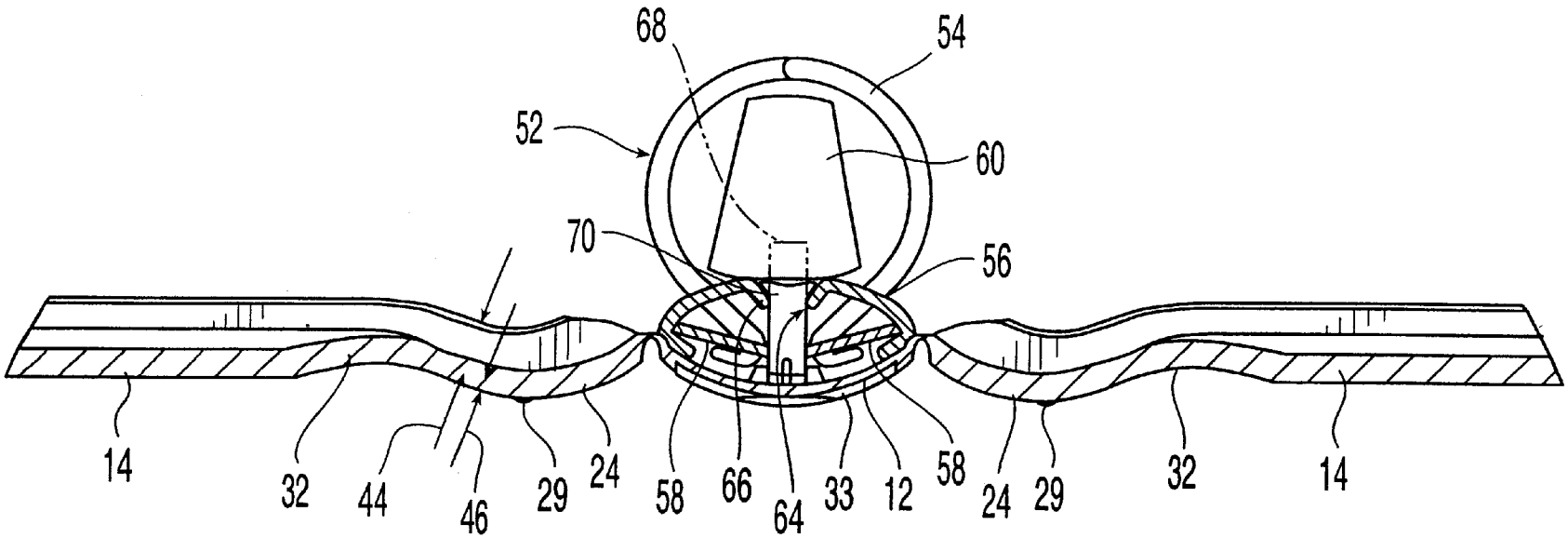
FIG. 6 is a cross-sectional side view of the spine and covers of another embodiment of the binder.

As shown in FIG. 5, at or near the perimeter of the covers 14 is a perimetral ridge 38 that extends at an angle of preferably more than about 45 degrees, and more preferably about 90 degrees from the covers 14. The covers 14 may blend smoothly into the ridge 38 so only the tip of the ridge is near 90 degrees from the covers 14. A plurality of webs 40, preferably three on each cover 14, reinforce ridge 38. The webs 40 preferably connect the portion of the ridge 38 extending along the free ends 22 of the covers 14 to the remainder of the cover 14. The height 42 of the ridge 38 is preferably about equal to or greater than the thickness 44 of the front and back portions of the covers 14, as shown in FIG. 6.

Also shown in FIG. 5 is a plastic pocket 45 that is heat sealed to one of the covers 14 and is open at the top and facing the spine 12 at dashed line 51. The pocket is preferably a polypropylene film with slits 53 shaped to receive business cards.

Preferably the plastic material for which the folder shell 10 is molded is translucent, so the contents of the pocket or of the papers bound in the binder are at least partially visible from the outside. In addition, the inside of the concave portions 32 is convex, and the inside of the support portions 24 is concave, as the folder shell 10 is constructed with a generally constant thickness.

Figure 7:
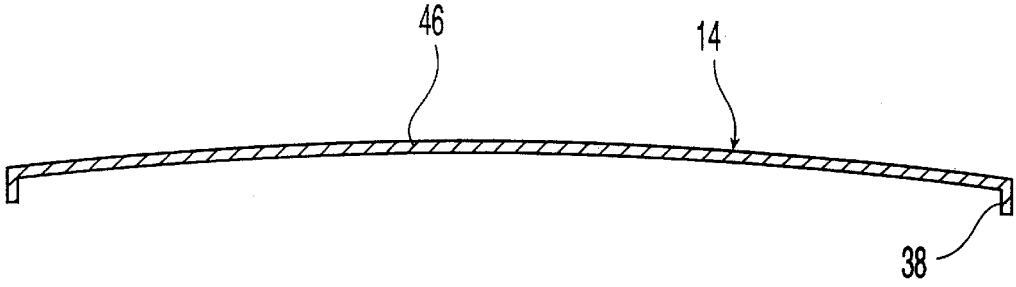
FIG. 7 is a cross-sectional view along section VII—VII of FIG. 1.
Figure 8:
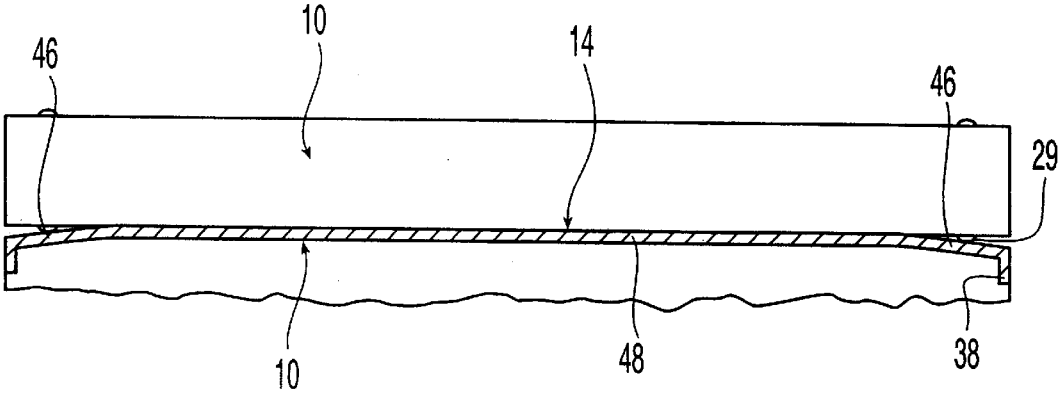
FIG. 8 is a cross-sectional view along section VIII—VIII of FIG. 1 with another similar binder stacked on the binder of FIG. 1.

Referring again to FIGS. 1 and 7–8, the each cover 14 has a arcuate portion 46 with an arcuate cross-section. Extending from the free end 22 is a substantially planar portion 48 that has a less arcuate cross-section than the arcuate portion 46. Thus, the free ends 22 are generally straight, and the curved covers 14 have increased strength compared to flat covers. In the preferred embodiment, the substantially planar portion 48 is generally triangular. In an alternative embodiment, the arcuate portion 46 extends up to the free end 22, with the cross-section flattening as it nears the free end 22.

As the concave portion 32 of each cover 14 is semi-cylindrical, and because the outer surface of the concave portion 32 is disposed outwardly from top and bottom or longitudinal edges 50 of each cover 14, the perimeter of the concave portion 32 is generally elliptical.

As shown in FIG. 6, the support portion 24 can have a toe 29 for improving traction when the folder shell 10 is laid on one of the covers 14. There are preferably four toes 29, which are preferably laterally elongated bumps, as shown in FIG. 1. Referring to the stacked binders of FIG. 8, the toes 29 of the top binder are disposed longitudinally beyond the elliptical extend of the concave portion 32. Also, the toes 29 preferably extend outwardly from the supporting portion 24 by less than the distance between the continuation of the spherical surface of the concave portion 32 and the arcuate portion 46, such that the toes fit therebetween without lifting the support portion 24 of the top folder shell 10 from the concave portion 32 of the bottom folder shell 10. Thus, the toes prevent longitudinal sliding of one folder shell 10 with respect to the other when the toes 29 engage the arcuate portion disposed longitudinally adjacent and inwardly with respect to the concave portion 32. Also, the toes 29 reduce scuffing of the support portions 24.

A binding assembly 52 is attached to the folder shell 10, preferably to the spine 12, but may also be attached to one of the covers 14. The binding assembly 52 with the folder shell 10 preferably forms a three ring binder. The binding assembly 52 is preferably a standard ring binder assembly that includes three split-rings 54 spaced and configured to attach papers with correspondingly spaced holes. The rings 54 are held by a retainer 56, which in the preferred embodiment is made from a bent sheet of steel. The rings 54 are fixed to an operating mechanism, which preferably includes hinged plates 58 which can be toggled by levers 60 to an open-ring position or a closed-ring position shown to open or close the rings 54, respectively.

The spine 12 preferably has a recessed portion 61 adjacent each lever 60 that prevents interference with a bottom portion of the levers 60 when the levers 60 are moved to open and close the rings 54. The spine 12 also has ridges 63 configured with notches 65 associated with the levers 60 to receive a lower part 67 of the levers 60 when they are rotated away from each other to open the rings 54. The ridges 63 preferably follow the general shape of the retainer 56, to protect the retainer 56 from impact.

The folder shell 10 has at least one but preferably a plurality of projections 62, preferably hollow posts, unitarily molded on the inside of the spine 12. In embodiments in which the binding assembly 52 is attached to one of the covers, the projections 62 are unitarily molded to that cover. The preferred projections 62 extend inwardly from the spine 12 and through holes 64 in the retainer 56 of the binding assembly 52. The projections 62 are illustrated as being aligned with the outer sets of the split-rings 54. In other words, each outer set of rings 54 lies in a plane substantially transverse to the spine 12 and the projections 62 are intersected by the planes containing the respective rings 54. The retainer 56 has preferably conical ferrules 66 defining the holes 64.

The plastic from which the folder shell 10 is molded is preferably deformable when heated and may be a thermoplastic or thermoset material. Preferably the plastic is polypropylene. The projections 62 are molded to a diameter receivable within the holes 64, as shown by dashed contour 68. The retainer 56 is placed against the spine 12 with the projections 62 received in the holes 64. The exposed ends of the projections are then heated and deformed to a configuration in which the end 70 is wider than the holes 64. When the deformed projection 64 is cooled, the projection 64 fixes the binding assembly 52 to the folder shell 10.

One of ordinary skill in the art can envision numerous variations and modifications. For example, the covers can be made from two parts that are fixed to each other, one of the parts being molded together with the spine. All of these modifications are contemplated by the true spirit and scope of the following claims.

What is claimed:

1. A folder comprising:

a spine having a base and first and second spine hinge portions, the spine defining a longitudinal axis and having an exterior surface that is curved around the longitudinal axis;

a first cover having a first cover hinge portion pivotably attached to the first spine hinge portion and a first curved portion adjacent the first cover hinge portion, the first curved portion having an exterior surface that is curved around the longitudinal axis; and a second cover having a second cover hinge portion pivotably attached to the second spine hinge portion and a second curved portion adjacent the second cover hinge portion, the second curved portion having an exterior surface that is curved around the longitudinal axis;

wherein the spine and the first and second curved portions together define a generally rounded contour around the longitudinal axis when the folder is in a closed position.

2. The folder of claim 1, wherein the rounded contour defined by the spine and the first and second curved portions extends along a generally circular shape around the longitudinal axis.

3. The folder of claim 1, wherein the rounded contour defined by the spine and the first and second curved portions extends along a generally elliptical shape around the longitudinal axis.

4. The folder of claim 1, wherein the rounded contour defined by the spine and the first and second curved portions extends over an angle of at least 180 degrees around the longitudinal axis.

5. The folder of claim 4, wherein the rounded contour defined by the spine and the first and second curved portions extends over an angle of about 185 degrees around the longitudinal axis.

6. The folder of claim 1, wherein the exterior surface of the spine has a radius of curvature, wherein the exterior surfaces of first and second curved portions each have a radius of curvature, and wherein the radius of curvature of the spine is larger than the radius of curvature of each of the first and second curved portions.

7. A binder comprising:

a folder including a spine having first and second spine hinge portions;

a first cover having a first cover hinge portion pivotably attached to the first spine hinge portion; and a second cover having a second cover hinge portion pivotably attached to the second spine hinge portion; and a binding mechanism coupled to the spine and configured for binding a stack of paper, the binding mechanism including at least two rings;

wherein the spine and the first and second covers each include an exterior surface that is curved around at least a portion of the rings and together define a generally rounded contour curving around at least a portion of the rings when the folder is in a closed position.

8. The binder of claim 7, wherein the rounded contour defined by the exterior surface of the spine and the exterior surfaces of the first and second covers extends along a generally circular shape around the rings.

9. The binder of claim 7, wherein the rounded contour defined by the exterior surface of the spine and the exterior surfaces of the first and second covers extends along a generally elliptical shape around the rings.

10. The binder of claim 7, wherein the rounded contour defined by the exterior surface of the spine and the exterior surfaces of the first and second covers extends over an angle of at least 180 degrees around the rings.

11. The binder of claim 10, wherein the rounded contour defined by the exterior surface of the spine and the exterior surfaces of the first and second covers extends over an angle of about 185 degrees around the rings.

12. The binder of claim 7, wherein the exterior surface of the spine has a radius of curvature, wherein the exterior surfaces of first and second covers each have a radius of curvature, and wherein the radius of curvature of the exterior surface of the spine is larger than the radius of curvature of the exterior surfaces of the respective first and second covers.

13. The binder of claim 7, wherein the spine includes a projection, such that when the binding mechanism is coupled to the spine, the projection is aligned with one of the two rings.

14. The binder of claim 7, wherein the binding mechanism is mounted directly to the spine.

15. A binder comprising:

a folder including a spine having first and second spine hinge portions and a projection;

a first cover having a first cover hinge portion pivotably attached to the first spine hinge portion; and a second cover having a second cover hinge portion pivotably attached to the second spine hinge portion; and a binding mechanism coupled to the spine and configured for binding a stack of paper, the binding mechanism including at least two rings;

wherein the projection is aligned with one of the two rings when the binding mechanism is coupled to the spine.

16. The binder of claim 15, wherein the ring in alignment with the projection lies in a plane transverse to the spine, and wherein the projection is intersected by the plane.

17. The binder of claim 15, wherein the projection is plastic.

18. The binder of claim 15, wherein the projection is a hollow post.

19. The binder of claim 15, wherein the projection is integral with the spine.

20. The binder of claim 15, wherein the binding mechanism defines a mounting opening and wherein the projection includes an end received through the mounting opening and dimensioned to prevent withdrawal therefrom and thereby attaching the mounting assembly to the folder.

21. The binder of claim 15, wherein the mounting projection comprises a deformable material, and the end of the projection is deformed to a dimension larger than the mounting opening.

22. The binder of claim 15, wherein the binding mechanism is mounted directly to the spine.

* * * * *